US011259614B1

(12) United States Patent
Ahrens

(10) Patent No.: US 11,259,614 B1
(45) Date of Patent: Mar. 1, 2022

(54) HAIR ROLLER

(71) Applicant: Hair4Good, LLC., Wilton, CT (US)

(72) Inventor: Mary Deborah Ahrens, Wilton, CT (US)

( * ) Notice: Subject to any disclaimer, the term of this patent is extended or adjusted under 35 U.S.C. 154(b) by 20 days.

(21) Appl. No.: 16/380,221

(22) Filed: Apr. 10, 2019

Related U.S. Application Data

(60) Provisional application No. 62/655,264, filed on Apr. 10, 2018.

(51) Int. Cl.
*A45D 2/14* (2006.01)
*A45D 2/36* (2006.01)

(52) U.S. Cl.
CPC ..... *A45D 2/146* (2013.01); *A45D 2/145* (2013.01); *A45D 2/362* (2013.01)

(58) Field of Classification Search
CPC ..... A45D 2/146; A45D 2/145; A45D 2/362; A45D 2/18; A45D 2/20; A45D 2/16
USPC ..... 132/226, 233
See application file for complete search history.

(56) References Cited

U.S. PATENT DOCUMENTS 1,552,618 A * 9/1925 Klemm, Jr. ..... A45D 2/2442 132/246
3,739,788 A * 6/1973 Keldmann ..... A45D 2/362 132/233
4,041,961 A * 8/1977 Shaler ..... A45D 2/00 132/245
4,164,951 A * 8/1979 Shaler ..... A45D 2/365 132/233
4,190,065 A * 2/1980 Kulpa ..... A45D 2/365 132/220
4,974,613 A * 12/1990 Ho ..... A45D 2/12 132/255
5,165,428 A * 11/1992 Stohr ..... A45D 2/18 132/246
5,299,367 A * 4/1994 Johnson ..... A45D 2/24 132/221
5,819,763 A * 10/1998 Hallowell, II ..... A45D 2/125 132/247
5,979,464 A * 11/1999 Teratani ..... A45D 2/14 132/223
6,283,128 B1 * 9/2001 Saxton ..... A45D 2/18 132/246
6,374,830 B1 * 4/2002 Afeworki ..... A45D 2/146 132/250
6,443,163 B1 * 9/2002 Merges ..... A45D 2/24 132/250
6,453,910 B1 * 9/2002 Lloyd ..... A45D 2/38 132/226
8,684,012 B1 * 4/2014 Ryan ..... G08C 17/02 132/227
9,226,560 B1 * 1/2016 Birk ..... A45D 4/06
(Continued)

*Primary Examiner* — Nicholas D Lucchesi
(74) *Attorney, Agent, or Firm* — Seyfarth Shaw; Jamaica Szeliga

(57) ABSTRACT

A hair roller for wrapping therearound a hair portion is a concave cylinder, which has a normally oval cross section at a top portion and a bottom portion thereof larger than a normally oval cross section at a middle portion thereof of an oval cylinder; an oval cylinder, which has at least one normally oval cross-section, or a concave oval cylinder. The hair roller is optionally provided with a hair-retaining structure formed on the roller body for grabbing the hair portion.

7 Claims, 10 Drawing Sheets

(56) References Cited

U.S. PATENT DOCUMENTS

| | | | | |
|---|---|---|---|---|
| 2004/0045573 | A1* | 3/2004 | Merges | A45D 2/2478<br>132/262 |
| 2004/0065340 | A1* | 4/2004 | Kelsey | A45D 2/20<br>132/265 |
| 2004/0163662 | A1* | 8/2004 | Kampel | A45D 2/362<br>132/226 |
| 2009/0194129 | A1* | 8/2009 | Junemann | A45D 2/12<br>132/226 |
| 2013/0152961 | A1* | 6/2013 | Sinnott | A45D 4/08<br>132/227 |
| 2015/0090286 | A1* | 4/2015 | Stubbs | A45D 2/12<br>132/211 |
| 2020/0069022 | A1* | 3/2020 | Chang | A45D 2/362 |

* cited by examiner

HAIR ROLLER

CROSS-REFERENCE TO RELATED APPLICATIONS

The present application is a nonprovisional application claiming benefit from a prior-filed provisional application bearing a Ser. No. 62/655,264 and filed Apr. 10, 2018, the entity of which is incorporated herein for reference.

FIELD OF THE INVENTION

The present invention relates to a hair roller for curling hair, and more particularly to a hair roller, which is specifically configured to exhibit an improved hair-curling effect.

BACKGROUND OF THE INVENTION

Conventional hair rollers 11 are round rollers generally configured as a hollow right circular cylinder, as shown in FIG. 1A, which has normally circular cross-sections of equal area. The term "normally" used herein means "in a direction normal to a tangent at a specified point". By dividing hair to be styled into a plurality of small portions and curling the hair portions around hair rollers 11, as shown in FIG. 1B, a hair-styling effect can be made. Subject to the monotonous shape of the round rollers, the hair styles that can be made with the conventional hair rollers are quite limited. Moreover, when curling a relatively large quantity of hair portion with the conventional round roller, hair is likely to escape from the roller from ends 111 and 112 of the roller and thus hard to be operated.

SUMMARY OF THE INVENTION

An object of the present invention is to provide a hair roller having a specifically designed configuration, which supports diverse hair styling with an improved hair-curling effect compared to the prior art.

The present invention provides a hair roller, comprising a roller body for wrapping therearound a hair portion, wherein the roller body is cylindrical in shape and has a normally oval cross-section.

The present invention also provides a hair roller, comprising a roller body for wrapping therearound a hair portion, wherein the roller body is a concave cylinder, which has a normally cross section at a top portion and a bottom portion thereof larger than a normally cross section at a middle portion thereof.

The present invention further provides a hair roller, comprising: a roller body for wrapping therearound a hair portion, wherein the roller body is a concave oval cylinder, which has a normally oval cross section at a top portion and a bottom portion thereof larger than a normally oval cross section at a middle portion thereof; and a hair-retaining structure formed on the roller body for grabbing the hair portion.

BRIEF DESCRIPTION OF THE DRAWINGS

The above contents of the present invention will become more readily apparent to those ordinarily skilled in the art after reviewing the following detailed description and accompanying drawings, in which.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 2:
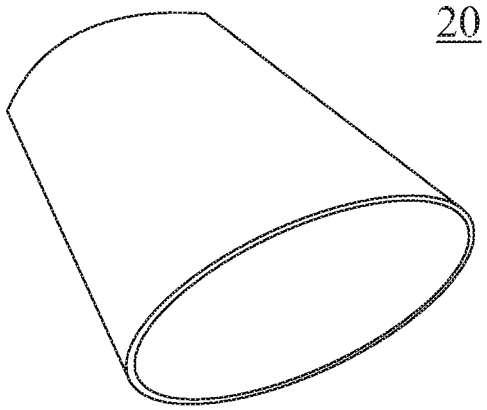
FIG. 2 is a schematic diagram illustrating a hair roller according to an embodiment of the present invention.
Figure 3A:
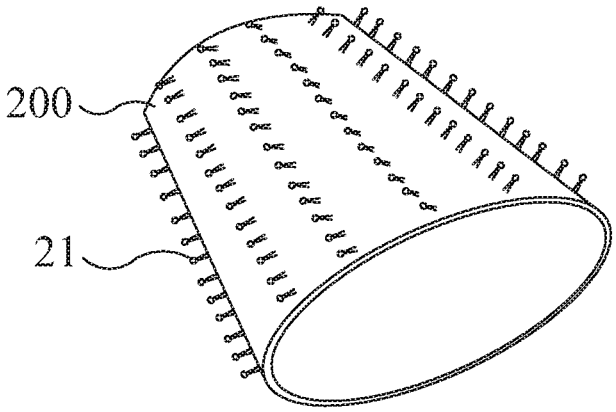
FIGS. 3A, 3B and 3C are schematic diagram illustrating modification examples of the hair roller as shown in FIG. 2.
Figure 3B:
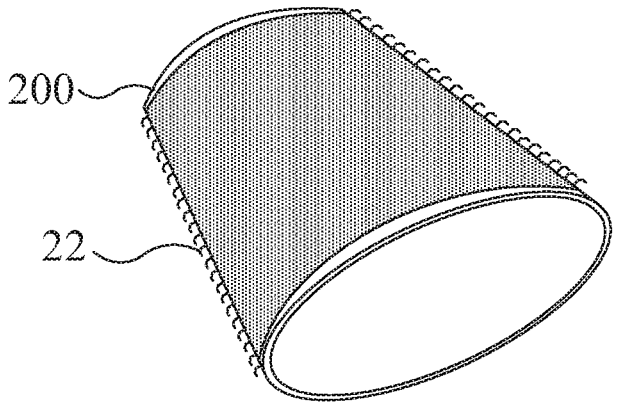
Figure 3C:
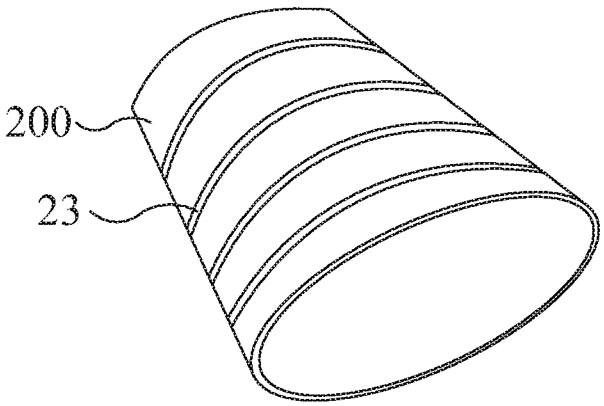

An embodiment of a hair roller according to the present invention is configured as an oval cylinder, which has normally oval cross-sections of equal area, as illustrated in FIG. 2. The oval hair roller 20 may be a hollow roller made of plastic, foam, rubber, silicone, metal, mesh, cloth/fabric or any other suitable material that has a vented or non-vented surface, or a combination of several different materials, which is relatively light and easy to be produced, for example, by way of injection molding. There are optionally bristles 21, Velcro® hook or loop piece 22 attached onto the circumferential surface 200 of the roller 20, and/or grooves 23 provided on the circumferential surface 200 of the roller 20, as illustrated in FIGS. 3A, 3B and 3C, respectively. The bristles 21, Velcro® hook or loop piece 22 and/or grooves 23 can physically grab hair portions in contact therewith and provide a frictional force with the hair portions to fix hair on the roller. Therefore, no or less auxiliary material, such as rubber bands or hairnet, is required for retaining hair on the roller 20.

Figure 1A:
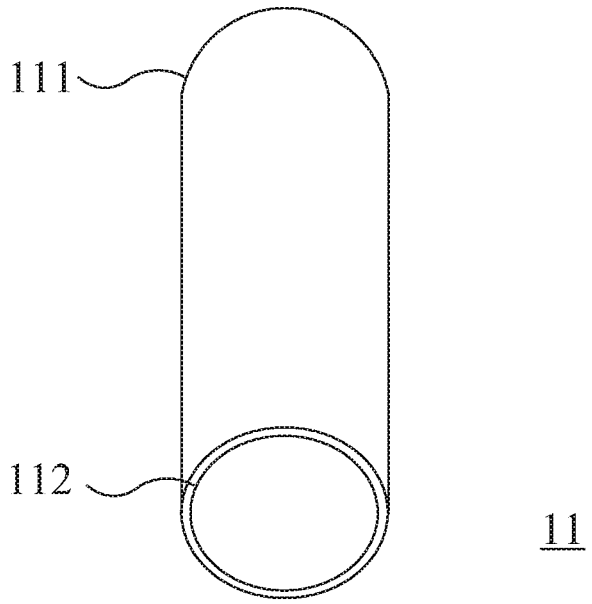
FIG. 1A (PRIOR ART)
FIG. 1A is a schematic diagram illustrating a conventional round hair roller.
Figure 1B:
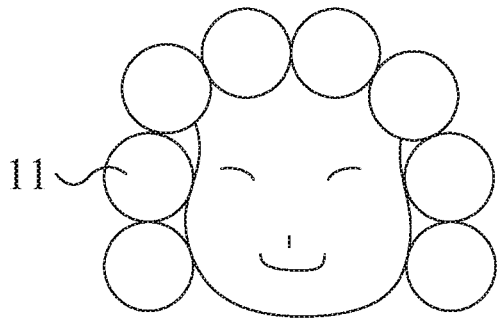
FIG. 1B (PRIOR ART)
FIG. 1B is a schematic diagram illustrating the use of conventional round rollers.
Figure 4:
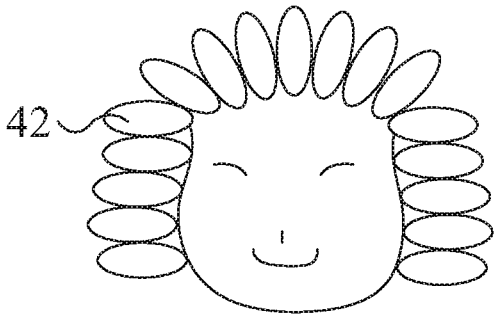
FIG. 4 is a schematic diagram illustrating an exemplified use of oval rollers according to an embodiment of the present invention.

The oval shape of hair rollers is advantageous in several ways. For example, according to life experiences, hair can be retained by an oval roller more easily and tighter than by a round roller. In addition, the number of oval rollers 42 that can be accommodated in a certain area of the user's head is more than that of conventional circular hair rollers 11 (see FIGS. 1A and 1B) having similar surface area, if the rollers 42 are allocated in a manner as shown in FIG. 4A. As such, some specific curling effects can be achieved. On the other hand, if a user would like to wear the rollers overnight, wearing oval rollers 42 would be easier than wearing round rollers 11 for sleep as long as the oval rollers 42 are properly distributed to constitute a substantially flat plane. Furthermore, by combining a variety of oval hair rollers with different sizes and in different orientations, and optionally conventional round rollers and/or other types of rollers, diverse hair styles can be created.

Figure 5A:
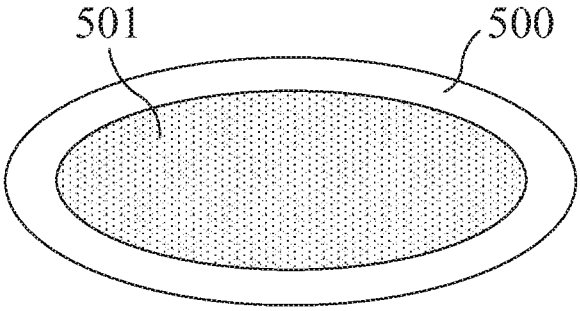
FIGS. 5A-5C are cross-sectional plane views schematically illustrating a hair roller according to different embodiments of the present invention.
Figure 5B:
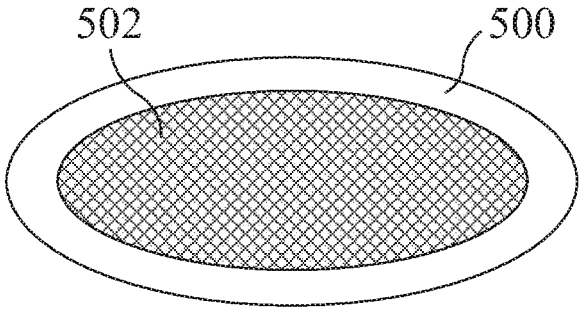
Figure 5C:
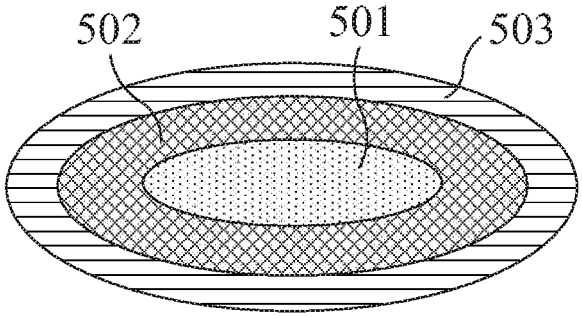

In the above embodiments, the oval rollers may be made hollow in consideration of lightweight while saving cost of material. A cushion material such as foam 501 can be added to the inside of the roller body 500 for comfort when the rollers are used overnight upon sleep, as illustrated in FIG. 5A. Alternatively, a metal or metallic material 502 may be added to the inside of the roller body 500 to help evenly heat the rollers and retain heat if the rollers are made of heat-resistant material and are previously supplied with heat before being installed onto hair, as illustrated in FIG. 5B. An oval roller according to the present invention may be integrally formed of a single material. Alternatively, it may be laminated with multiple layers formed of different materials, for example, a foam layer 501 inside, a metal layer 502 in the middle and a plastic material 503 outside, as illustrated in FIG. 5C.

Figure 5D:
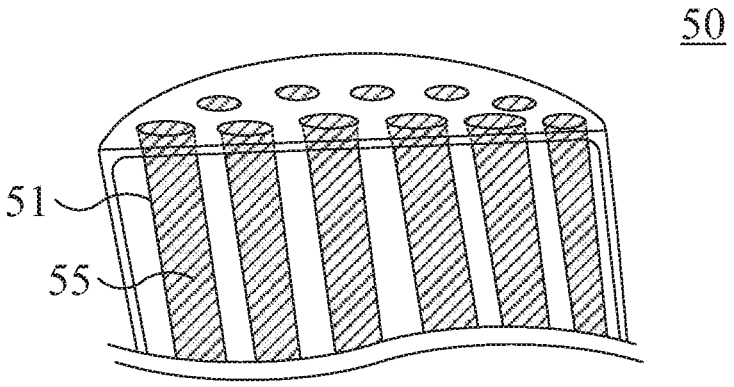
FIGS. 5D and 5E are cross-sectional perspective view schematically illustrating a hair roller according to different embodiments of the present invention.
Figure 5E:
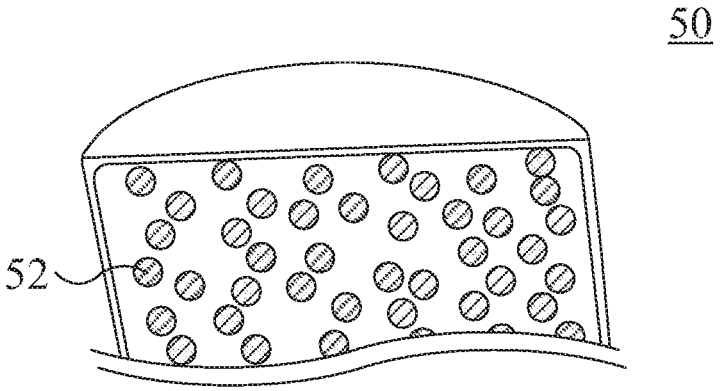

In another embodiment of the present invention, an oval roller may be made solid and includes one or more heating elements. A cross-sectional view of an exemplified solid oval roller 50 is schematically illustrated in FIG. 5D. The oval roller 50 is a thermo-roller including a plurality of channels 51 for inserting or filling therein heater material 55. For example, the heater material 55 can spontaneously dissipate heat and/or be heated after being placed in the channels 51. Alternatively, as illustrated in FIG. 5E, the oval roller 50 is a thermo-roller embedded with one or more heater elements such as beads 52 or any other suitable thermos-cells, which can be repetitively heated by, for example, microwave, oven, electricity, steam, sun, induction, battery, rechargeable battery, or any other suitable heating source. For heating operations, it is preferred that the material of the roller is heat-resistant to avoid damage. Meanwhile, it is desirable that the material of the roller exhibits heat-retaining, heat-conducting and heat-dissipating capabilities. Ceramic, copper, aluminum, titanium, foil, iron, steel, carbon fiber, fiber glass, clay, porcelain, magnesium, brass, gold, silver, tungsten and metallic materials or alloys of such are some of the examples of the heat-resistant and heat-conductive materials. The heating means, for example, may be microwave, oven, electricity, steam, solar, induction, battery, rechargeable battery, butane or a similar in a gaseous or liquid phase, or any other suitable heating source.

Figure 6A:
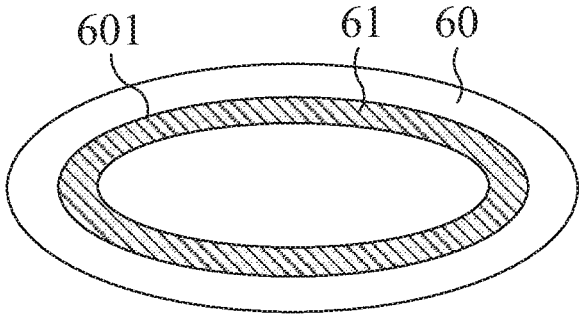
FIGS. 6A and 6B are schematic diagrams illustrating two alternative embodiments of oval rollers according to the present invention.
Figure 6B:
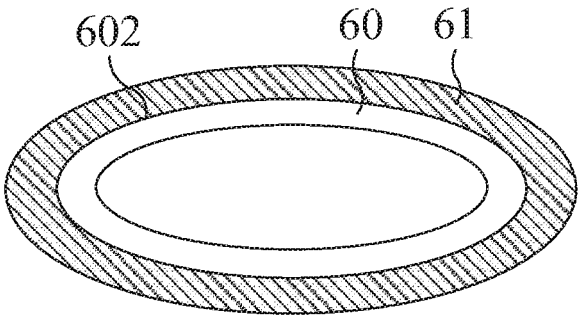

FIG. 6A and FIG. 6B schematically illustrate two alternative embodiments of oval rollers according to the present invention. In these embodiments, a heater sheet, which can spontaneously dissipate heat and/or be heated after being placed in the hair roller, may be additionally used for enhancing the heating efficiency. The heater sheet 61 may wrap an inner surface 601 (FIG. 6A) or an outer surface 602 (FIG. 6B) of the hair roller body 60. The heater material, for example, may be selected from ceramic, copper, aluminum, titanium, foil, iron, steel, carbon fiber, fiber glass, clay, magnesium and metallic materials. The materials applicable in a reflective foil technology, such as heat-reflective aluminum film coated fiber glass fabric or cloth, a ceramic fiber paper, PTFE (Polytetrafluoroethylene) rope with graphite coating, weld backing tape, etc., may also be used in the present invention as the heater material. Other examples include graphite, graphite gold foil, metallic foils and metals.

Figure 7:
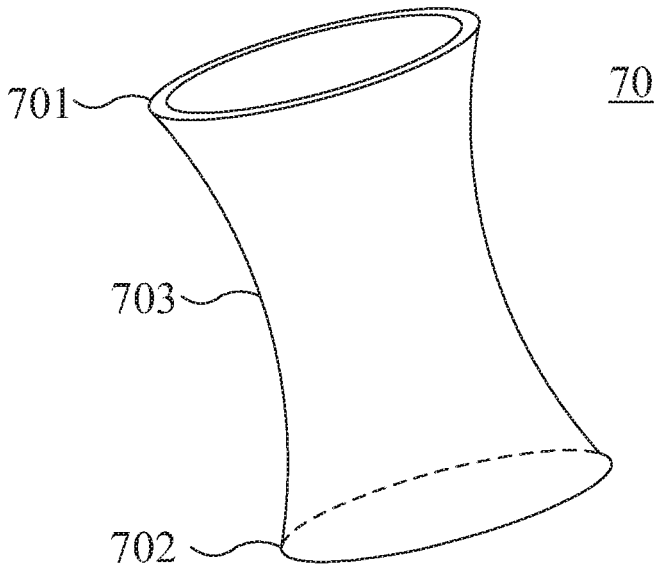
FIG. 7 is a schematic diagram illustrating a concave oval hair roller according to an embodiment of the present invention.
Figure 8A:
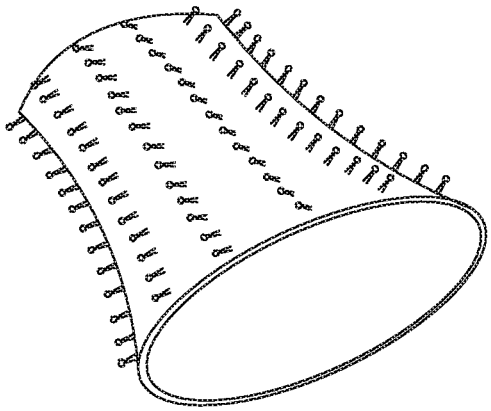
FIGS. 8A, 8B and 8C are schematic diagram illustrating modification examples of the concave oval hair roller as shown in FIG. 7.
Figure 8B:
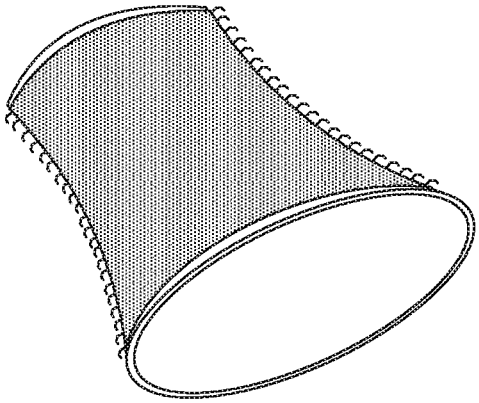
Figure 8C:
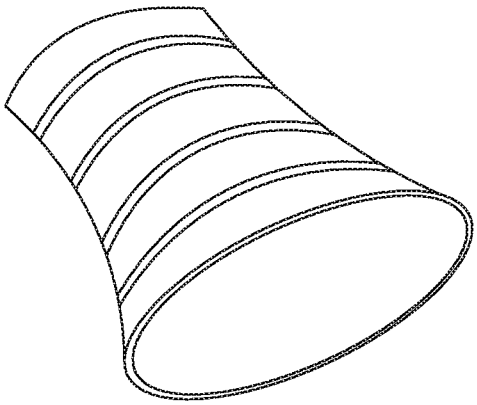

FIG. 7 schematically illustrates an oval roller according to a further embodiment of the present invention. The oval roller in this embodiment is a concave oval roller 70, which have normally oval cross sections of different area. In addition to the above-mentioned benefits of oval rollers, the concave oval roller 70 is further beneficial in, for example, avoiding hair from escaping from ends of the hair roller as the concave oval roller 70 has larger top/bottom portions 701/702 than the middle portion 703. An oval roller according to the present invention may have more than one concave portions so that the entire roller has different cross-sectional areas lengthwise. In addition to the advantage of tight rolling, the different sizes of the roller facilitate diverse hair-curling effects. In addition, the concave oval roller 70 can result in a tighter curl at the base of the curl. The bottom part of a curl falls out the fastest due to the hair weight. The concave oval roller 70 holds a curl much longer than a conventional round roller. The concave oval roller 70 allows for a tighter and longer lasting curl. Moreover, the concave oval roller 70 will reduce frizz better than a conventional round roller because the frizzier part of hair will have a tighter curl. Likewise, the concave oval roller 70 may be modified in the ways as described above with reference to the oval rollers according to the present inventions. For example, it may have bristles, Velcro® hook or loop piece and/or grooves provided on its circumferential surface, as illustrated in FIGS. 8A, 8B and 8C. It may be hollow or solid with or without heating elements. It may be made of any suitable material under different considerations. The contour of the concave oval roller 70 may also be modified.

Figure 9:
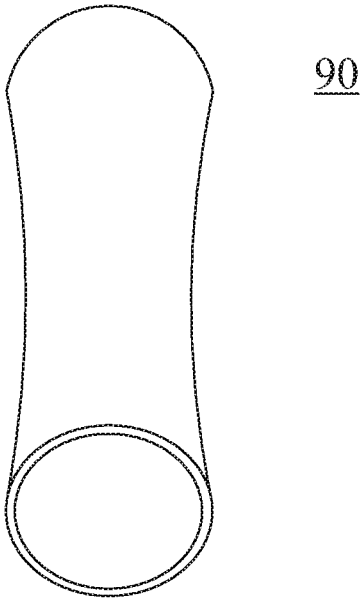
FIG. 9 is a schematic diagram illustrating a concave round hair roller according to an embodiment of the present invention.

It is to be noted that although the concave hair rollers as described above with reference to FIGS. 7 and 8A-8C are of a cross-sectionally oval shape, it is not necessary to make them oval. A round roller 90 with a concave configuration, as shown in FIG. 9, can also achieve the same purpose of better retaining of hair on the roller 90.

It is to be noted that although the oval rollers described in the above embodiments have oval cross-sections, the oval cross-sections do not have to be symmetrically right or smoothly oval. Instead, minor or local modifications can be made according to the spirit of the present invention and practical requirements. For example, the oval cross sections may be leaf-shaped having a larger radius of curvature at one end and a smaller radius of curvature at the opposite end, and/or having a zigzag contour.

It is also to be noted that in spite the rollers described in the above embodiments are stand-alone, they may be alternatively used with additional parts depending on practical requirements. For example, if the rollers are thermo-rollers and too hot to be held with bare hands, the rollers may further include a coupling member at one or both ends thereof so that a handle may be attached to the coupling member of the roller for facilitating a curling operation, and detached from the coupling member after the curling operation has been done.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A hair roller, comprising a roller body for wrapping therearound a hair portion, wherein the roller body is a continuously curved concave cylinder, which has a normally oval cross section at a top end and a bottom end thereof larger than a normally oval cross section at the midpoint thereof, wherein none of the cross sections from the top end to the midpoint have the same area; and none of the cross sections from the bottom end to the midpoint have the same area.

2. The hair roller according to claim 1, further comprising a hair-retaining structure formed on the roller body for grabbing the hair portion and/or confining a movement range of the hair portion on the roller body.

3. The hair roller according to claim 2, wherein the hair-retaining structure includes bristles, a piece of hooks and/or loops attached onto the roller body, grooves provided on the roller body for receiving therein the hair portion, or a combination thereof.

4. The hair roller according to claim 1, wherein the roller body is a hollow cylinder.

5. The hair roller according to claim 4, further comprising a cushion material and/or a heat-conductive material formed inside the hollow cylinder.

6. The hair roller according to claim 1, wherein the roller body is a solid oval cylinder.

7. The hair roller according to claim 6, further comprising a plurality of channels distributed in the solid oval cylinder for inserting or filling therein a heater material, which can spontaneously dissipate heat and/or be heated after being placed in the channels.

* * * * *